US006438919B1

(12) United States Patent
Knauseder

(10) Patent No.: US 6,438,919 B1
(45) Date of Patent: Aug. 27, 2002

(54) BUILDING COMPONENT STRUCTURE, OR BUILDING COMPONENTS

(75) Inventor: Franz Knauseder, Salaburg (AT)

(73) Assignee: M. Kaindl, Wals (AT)

( * ) Notice: Subject to any disclaimer, the term of this patent is extended or adjusted under 35 U.S.C. 154(b) by 0 days.

(21) Appl. No.: 09/462,643

(22) PCT Filed: Jun. 18, 1998

(86) PCT No.: PCT/AT98/00153

§ 371 (c)(1),
(2), (4) Date: May 25, 2000

(87) PCT Pub. No.: WO98/58142

PCT Pub. Date: Dec. 23, 1998

(30) Foreign Application Priority Data

Jun. 18, 1997 (AT) ..... A 1067/97

(51) Int. Cl.[7] ..... E04B 2/00

(52) U.S. Cl. ..... 52/586.2; 52/590.2; 52/590.3; 52/592.4; 52/592.1; 52/588.1; 52/582.2

(58) Field of Search ..... 52/592.4, 590.3, 52/590.2, 592.1, 586.2, 588.1, 582.2

(56) References Cited

U.S. PATENT DOCUMENTS 2,982,380 A * 5/1961 Rose ..... 189/34
3,347,048 A * 10/1967 Brown et al. ..... 61/37
5,502,939 A 4/1996 Keine
6,006,486 A * 12/1999 Moriau et al. ..... 52/589.1
6,101,778 A * 8/2000 Martensson ..... 52/582.1
6,209,278 B1 * 4/2001 Tychsen ..... 52/592.4
6,216,409 B1 * 4/2001 Roy et al. ..... 52/589.1

FOREIGN PATENT DOCUMENTS

| | | |
|---|---|---|
| DE | 9317191 | 3/1995 |
| DE | 29710175 | 8/1997 |
| GB | 2256023 | 11/1992 |
| WO | 9401628 | 1/1994 |
| WO | 9404773 | 3/1994 |
| WO | 9627721 | 9/1996 |

* cited by examiner

*Primary Examiner*—Carl D. Friedman
*Assistant Examiner*—Christy Green
(74) *Attorney, Agent, or Firm*—Millen, White, Zelano & Branigan, P.C.

(57) ABSTRACT

The invention relates to flat and/or elongated building components (1, 2), preferably wooden, and a structure connecting these components (1, 2) in accordance with the groove and tongue principle. Two legs (3, 4) forming a groove (5) branch off from a front face of one of the components (1), and a tongue (6) branching off from a front face of the other component (2) can be inserted into the groove (5). Locking elements (7, 8) hold the components (1, 2) in an assembled position. In accordance with the invention, the locking elements are configured as triangular projections (7) and cavities (8) in facing or adjacent surfaces of the groove and/or tongue.

24 Claims, 2 Drawing Sheets

BUILDING COMPONENT STRUCTURE, OR BUILDING COMPONENTS

Figure 1:
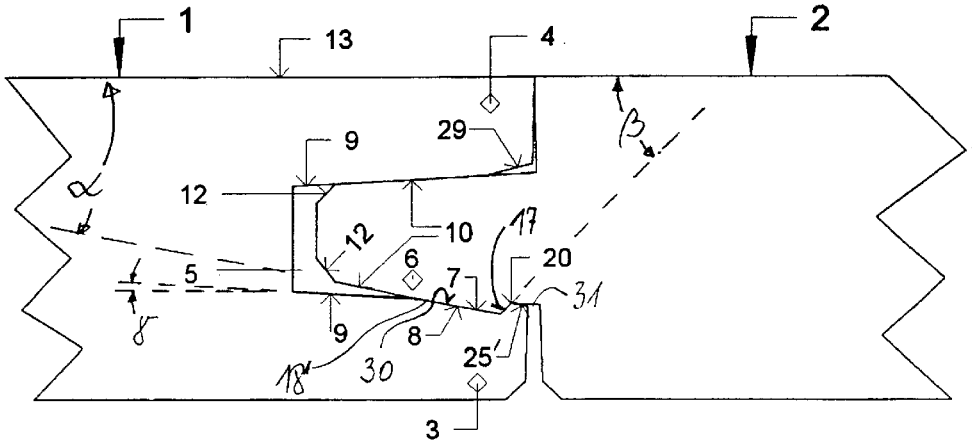

The invention relates, on the one hand, to an arrangement of building components, and on the other hand to the building components themselves, to an arrangement of panel-shaped or strip-shaped building components made of wood, wood material or a wood-based material.

Panel-shaped building components include, for example, building panels, floor panels, cladding panels, cladding strips, or similar, used in particular for covering the walls, ceilings or floors of all types of buildings. Such components may consist of single of multi-ply panels or strips of wood or wood-based material that may be laminated on one or both outer surfaces. The lamination may take the form of plastic sheets, wood or plastic veneers, etc. In particular, the invention is concerned with floor panels made of wood and having relatively hard surfaces consisting of laminated plastic layers.

Arrangements of such components, or such components themselves, discussed above are known prior art.

The invention relates in particular to the special manner of connecting such structural elements in order to secure the latter in an optimal position relative to each other in the connected state, with the assistance of looking elements, while at the same time being able to disconnect the components if required.

In addition to this specific goal of the invention, the purpose of the features of the invention is to ensure that the looking elements to be produced are as simple and economical as possible in design and do not require the use of additional aids, so that the components can be fitted or joined together quickly and reliably in a manner that is non-damaging to the materials involved.

According to the invention, in the case of building components or an arrangement to connect building components, an arrangement of panel-shaped or strip-shaped building components (1, 2) made of wood, wood material or a wood-based material, possibly having, for example, plastic laminated layers on the top and/or bottom surfaces, e.g. building panels, floor panels, cladding panels, or cladding strips, and the like, or such components, said components (1, 2) having possibly a flat bottom surface (15) for placing on a flat substrate, said components (1, 2) being connectable with each other by the tongue-and-groove principle and having two in particular equally long legs (3, 4) projecting from at least one of the end faces of the one component (1) and forming between from a groove (5), into which groove (15) is insertable a tongue (6) projecting from one of the end faces of the respective other component (2), said components having locking elements matched to each other in the form of a recess or depression (8) or in the form of a projection (7) formed on at least one side of the groove (5) and on at least one side of the tongue (6), and preferably over the entire length of the groove (5) and the tongue (6), in order to hold joined components (1, 2) in the joined position, characterized in that,

- in particular in order to achieve a firm but detachable connection between the components (1, 2) the groove (B) is directly formed in, and in particular is cut or milled in, component (1),
- the tongue (6) is of integral one-piece construction with the component (2), from which is in particular machined or milled,
- the width (B) of the groove (5) increases from the inside to the outside
- the thickness (D) of the tongue (6) decreases in the direction towards its free end

- the projection (7) on the tongue (B) possesses a longer front surface (18, 30) forming an angle ($\alpha$) with the top surface (13) of the components (1, 2) said projection (7) also possesses a shorter rear surface (17) merging with this aforementioned front surface via a sharp bend and forming an angle ($\beta$) with the top surface (13) of components (1, 2) that is larger than the angle ($\alpha$), the recess (8) in the groove (5) possesses a contact surface (18') close to the base of the groove, which surface, in the locked position, is in at least partial contact with the long front surface (18, 30), and said recess also possesses a shorter contact surface (17') located away from the base of the groove, which surface, in the locked position, is in contact with the shorter rear surface (17) of the projection (7).
- and at least one of the two, and preferably both, legs (3, 4) forming the groove can be flexibly bent outwards relative to the respective other leg of the groove, so that the tongue (6) is clamped in the engaged position by the legs (3, 4) of the groove, or it may be inserted into or withdrawn from the groove (5) by elastically flexing the legs (3, 4) of the groove.

It should be mentioned that the tongue is of solid one-piece construction with the components from which it is shaped.

The width of the groove, which increases from the inside to the outside, or the thickness of the tongue, which decreases in the direction towards its free end, are matched to each other so that, when the components are joined together, the surfaces of the groove and of the tongue are in full contact with one another. As a result, the components are held in a defined position in relation to each other.

The detachability of the connection is substantially enhanced by the fact that the surface of the projection formed on the tongue, said surface being close to the component, and the surface of the recess formed on the groove, said surface being close to the opening of the groove, run obliquely or slantingly in the direction of the component or the groove opening, so that the tongue can be withdrawn from the groove. The introduction and withdrawal of the tongue is possible because at least one of the legs of the groove is elastically widenable in respect to the other leg, or can be elastically moved away from the other leg; in particular, the two legs of the groove are made of a material strong enough to permit them to bend elastically outwards, thus permitting the tongue to be inserted into the groove. In the process, the projection, of which at least one is provided on the tongue, can move past the inner edges at the opening of the groove by sliding along these inner edges, thereby forcing the legs of the groove apart.

The locking elements provided to ensure the positionally fixed connection of the components, said locking elements being formed by mutually matched projections and recesses, are formed on the groove and on the tongue. These locking elements may be provided at intervals along the groove and tongue, but better engagement is achieved and manufacture is simplified if these locking elements extend over the entire length of the grooves and tongues provided.

In one particularly advantageous embodiment of the invention, appropriate projections are formed on both sides of the tongue and appropriate recesses are formed on both sides of the groove, because this achieves a double locking engagement and thus a firm connection between the components.

The components may be of any desired width. Components of the same width or components of different width may be joined with one another in order, for example, to achieve a certain floor configuration.

As regards the connecting together or the disconnection of the components, it is advantageous to proceed according to the features set forth such that an arrangement as disclosed previously is characterized in that the angle (α) formed between the front surface (10) and the top surface (13) of the components (1, 2) is greater than the angle (γ) formed between the area of the groove surface (9) close to the base of the groove and the top surface (13) of the components (1, 2) (FIG. 1), and is characterized in that when the projection (7) is formed on only one side of the tongue (6) and the recess (8) is formed only on the side of the groove (5) facing this side, the surfaces of the tongue (6) and of the groove (5) which are not provided with a projection or recess are in full contact with one another and form the same angle (γ) with the top surface (13) of the components (1, 2).

Figure 2:
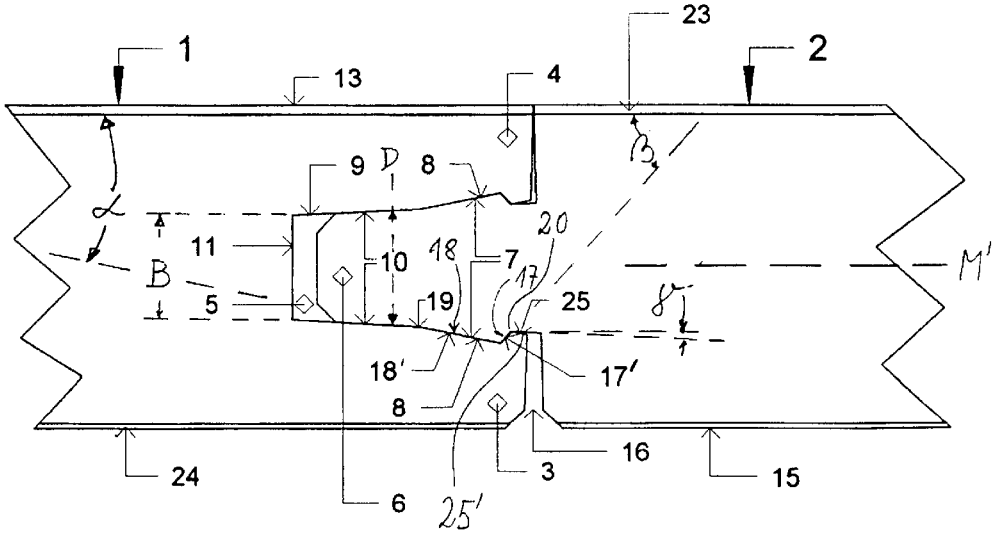

A preferred embodiment of the invention is characterized in that, the tongue surfaces (10) close to the end of the tongue possess the same angle of inclination (γ) relative to the top surface (13) of the components (1, 2) as the groove surfaces (9) in the areas close to the base of the groove, against which areas the tongue surfaces (10) close to the end of the tongue are in contact when the components (1, 2) are fitted together, along at least one groove surface (9), preferably the groove surface (9) close to the top surface of the components, and in particular in both groove surfaces (8), there is formed, as a locking element, a recess or depression (8) having a triangular shape in the cross section perpendicular to the direction in which the components (1, 2) are fitted together, along at least one tongue surface (10), preferably on the tongue surface (10) close to the top surface of the components, and in particular on both tongue surfaces (10), there is formed a projection (7) having a triangular shape in the cross section perpendicular to the direction in which the components (1, 2), the projection (7) and the recess (8) are in full contact with each other, without any play, along their contours (FIG. 2).

This cross section shape of a tongue, having at least one projection formed thereon and having at least one corresponding recess formed in the groove, permits the surfaces of the tongue, or of the projection provided on the tongue, to slide easily on the surfaces of the groove, or on the surfaces of the groove that directly adjoin the opening of the groove, when the tongue is introduced into the groove.

The features characterized in that when the components (1, 2) are in the locked position, substantially the entire area of the tongue surface (10) located ahead of the projection (7) in the direction of the front end of the tongue is in contact with the groove surface (9) result in firm locking engagement of the two components to be joined.

For the purpose of introducing the tongue of the one component into the groove of the other component, and also for the purpose of detaching said tongue, it is particularly advantageous to proceed according to the feature characterized in that the longest triangle side of the recess (8) is located along or in the plane of the groove surface (9), the triangle side (17') closer to the opening of the groove being shorter and inclined at a larger angle (β) relative to the top surface (13) than the triangle side (18') that is located closer to the base (11) of the groove and is inclined at an angle (α) relative to the top surface (13), characterized in that the longest triangle side of the projection (7) is located along or in the plane of the tongue surface (10), the triangle side (17) located away from the free end of the tongue being shorter and inclined at a larger angle (β) relative to the top surface (13) than the triangle side (18) that is located close to the free end of the tongue and is inclined at an angle (α) relative to the top surface (13), and further characterized in that the projection (7) formed on the tongue (6) has a cross-sectional shape corresponding to the triangular shape of the recess (8). When this method is employed, the resistance encountered when detaching or withdrawing the tongue from the groove is higher than the resistance encountered when introducing the tongue into the groove; however, the tongue is firmly engaged in the groove, yet at the same time this locking engagement can easily be reversed.

It is not necessary to form an elastically yielding tongue or tongue sections because the legs of the groove possess sufficient elasticity to be able to open up appropriately when the tongue is introduced.

It is advantageous if the features characterized in that the triangular projection (7) on the tongue (6) is located between surface areas of the tongue (6) having the same angle of inclination (γ) relative to the top surface (13) of the components (1, 2) are provided, because these result in a defined design of the tongue and groove that is easy to manufacture and that permits good contact between the tongue and the groove.

The features characterized in that, between the opening of the groove and the start of the shorter triangle side (17') of the recess (8), the surface area (25') of the groove surface (9) forms an angle with the top surfaces (13) of the components (1, 2) that corresponds to the angle of inclination (α) of the longer triangle side (18'), so that this surface area (25') of the groove (8) forms the sliding surface for the longer triangle side (18) of the projection (7) provided on the tongue (6) simplify the introduction of the tongue into the groove.

The features characterized in that the area of the tongue surface (10) close to the free end of the tongue, and also the area of the tongue surface (10) close to the end face of the components (2), merge into the longer (18) and the shorter (17) triangle sides of the projection (7), in each case via a bend (19, 20), define exactly the position of the tongue in the groove, because the projection comes to rest exactly in the recess and thus the projection and the recess, or the surfaces of the tongue and the surfaces of the groove, abut exactly and in full-surface contact with each other.

When the cross section of the triangular projection, or of the projection of the tongue engaged in the recess in the groove, is designed such that the triangle side (18) close to the bottom of the groove (FIG. 2), or the section (30) of the tongue surface (10) received by the recess (8) (FIG. 1), is about four to eight times, preferably five to seven times, as long as the triangle side (17) located away from the base of the groove (FIG. 2) or the shorter rear surface (17) (FIG. 1), and also characterized in that the angle between the two triangle sides (17, 18), or between the section (30) of the tongue surface (10) and the shorter rear surface (17), is 100 to 140°, and in particular 110 to 130°. This simplifies the introduction of the tongue into the groove or offers the tongue firm engagement in the groove, yet at the same time permits withdrawal of the tongue from the groove without damaging the material.

The invention is further characterized in that the longer triangle side (18, 18') and the shorter triangle side (17, 17') of the projection (7) or of the recess (8) merge into the front or rear area of the groove surface (9) and of the tongue surface (10), via a bend (19, 20).

The features characterized in that the end face of the leg (4) of the groove in the one component (1), said leg being located close to the top surface of the component and possessing possibly a rounded or chamfered inner surface (29), is in contact with the end face area of the other component (2), said and face area being located close to the top surface of the component, and/or characterized in that the end face of the leg (3) of the groove of the one component (1), said leg being located close to the bottom surface of the said component, is located at a distance from the end face area of the other component (2), said end face area being located close to the bottom of the said component are advantageous for avoiding tilting when introducing the tongue into the groove. Furthermore, the features of this claim help to ensure that the end-face surfaces of the components to be joined by the engagement of the projections of the tongue in the recess of the groove are in close contact with one another or are brought close together with one another so that no gaps are formed.

It has been found in practice that the features characterized in that the groove (5) and the tongue (6) are formed in the middle section of the respective and faces of the components (1, 2) or symmetrically in relation to a horizontal mid-plane of the components (1, 2), are advantageous, because the manufacture of the groove and tongue is simplified, or the force is transmitted without damaging the material.

When the features characterized in that the arrangement comprises components (1) bearing on one of their end faces a groove (5) and on the respective other and face a tongue (8), and also comprising components (1) bearing on both opposite end faces or on all end faces grooves (5) or tongues (6) respectively, and/or characterized in that the components (1, 2) are of symmetrical or identical configuration in relation to a plane running perpendicular to their surface and through the longitudinal and/or transverse id-axis, or characterized in that the components (1, 2) are of different widths, and the components (1) bearing grooves (5) at their opposite and faces are possibly panel-shaped or wide in dimension, and the components (2) bearing tongues (6) are of narrow, strip-shaped or elongate configuration, are adopted, the components are easy to install and at the same time are optically attractive. In this way, relatively wide, panel shaped components, not necessary elongate but also, for example, rectangular or square in configuration, are held together by relatively narrow, strip-shaped components, thereby not only resulting in a pleasing pattern, but also simplifying the installation technique.

Further advantageous embodiments of the invention are apparent from the following description, the drawings and the patent claims.

In the following, the invention is described in more detail on the basis of the drawing.

Figure 3:
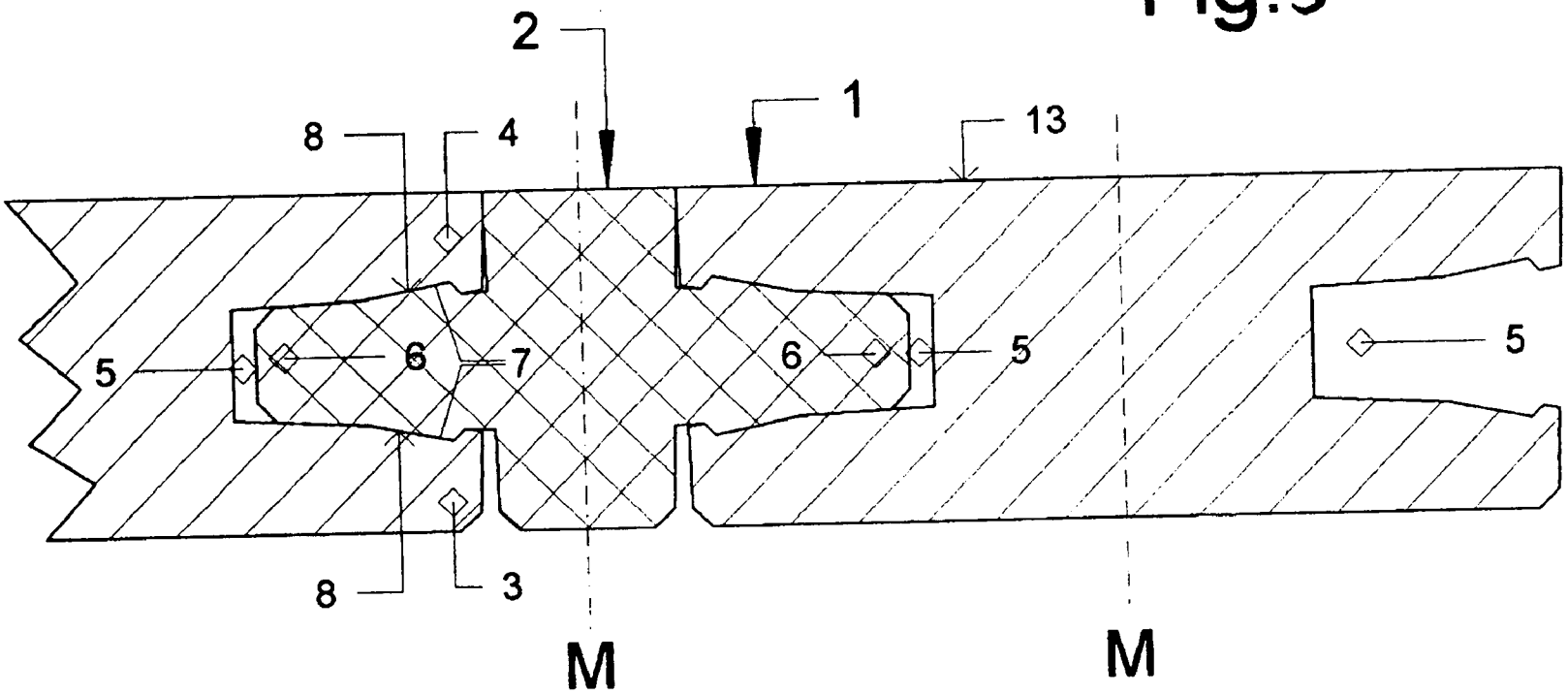

FIGS. 1 and 2 show in diagrammatic form a sectional view of components joined in accordance with a first embodiment of the invention, and FIG. 3 shows in diagrammatic form components joined together with one another.

FIG. 1 shows two components 1, 2 that are to be joined to one another. In the one component 1 there is formed a groove 5 into which is insertable a tongue 6 projecting from the other component 2, the end faces of the components 1, 2 abut in the area close to the top surface of said components, while in the area of the bottom surface of the said components a gap 16 is formed.

The components 1, 2, which consist in particular of wood or plastic, may be provided with laminated layers 23, 24 to provide appropriate surface values or an attractive appearance.

Locking elements 7, 8 adapted to one another are provided on the tongue 6 or the tongue surfaces 10 and in the groove 5 or in the groove surfaces or the lateral surfaces 9 of the groove 5. These locking elements are formed by projections 7 and recesses 8 that interact with or are engageable in one another. The cross-sectional shapes of the recesses 8 and of the associated projections 7 correspond to each other so that the locking elements engage fully one within the other.

When the components 1, 2 are assembled, the locking elements 7, 8 are engaged with each other. The locking elements 7, 8 are in particular formed over the entire length of the longitudinal and/or narrow sides of the components 1, 2.

In FIG. 1, a projection 7 is formed on a tongue surface 10, and this projection is received by a recess 8 in the groove surface 9 abutting this tongue surface 10. When the tongue 6 is introduced into the groove 5, both legs 3, 4 of the groove 5, are forced elastically apart; when the tongue 6 is withdrawn from the groove 5 the legs 3, 4 of the groove are also elastically spread apart.

In the embodiment of the invention depicted in FIG. 1, a projection 7 is formed on only one side of the tongue 6. The projection 7 is formed in such a manner that the tongue surface 10 runs in a straight line from the free front end of the tongue 6 until it bends sharply at the thickest point of the tongue and merges into a short rear surface 17, which is turn merges into a surface 31 leading to component 2. Only a partial area 30 of the tongue surface 10 is received by the recess 8 in the groove surface 9; however, in the recess, this partial area of the tongue surface is in full contact with the surface 18'; the rear, shorter surface 17 is also in full contact with the surface 17' of the recess 8, said surface being located close to the opening at the groove.

The groove surface 10, or a partial area 30 thereof, is inclined at an angle $\alpha$ to the top surface 13 of the two components 1, 2; the shorter rear surface 17 is inclined at an angle $\beta$ to the top surface 13 of the two components 1, 2. The same applies to the two surfaces 17' and 18' of the recess 8 in the leg 3 of the groove. The area of the groove surface 9 located outside the recess 8 of the leg 3 of the groove, or close to the base of the groove, is inclined at an angle $\gamma$ to the top surface 13 of the two components. The surface 10 of tongue 6 that carries no projection and is in full contact with the facing groove surface 9 is inclined at the same angle $\gamma$.

In order to form a defined, mutual position of the locked components 1, 2 it may be advantageous if, relative to the functional surface or top surface 13, the angle $\alpha$ of the long side 18 of the triangular projection 7 on the tongue 6 corresponds to the angle or the inclination, in particular of the front area, of the tongue surface 10, which front area runs at a distance from the groove surface 9. Over most of its length, the tongue surface 10 which has no locking elements is in contact with the inner surface 9 of the groove and, seen from the base 11 of the groove, both surfaces approach the top or functional surface 13 of both components 1, 2 at an angle $\gamma$.

In practice, it is advantageous if the recess or the groove are provided in the groove and tongue surfaces close to the top surface of the components. It is particularly advantageous if corresponding locking elements are provided in both tongue surfaces and in both groove surfaces.

As can be seen from FIG. 1, when the tongue 6 is inserted into the groove, the legs 3, 4 of the groove are moved apart from each other. In particular, the surface 25' close to the opening of the groove, and the tongue surface 10, and in particular the area 30 thereof, slide over each other so that the legs 3, 4 of the groove are spread apart without being damaged. When the tongue 6 is withdrawn from the groove 5, the spreading of the legs 3, 4 of the groove is achieved by the surfaces 17 and 17' sliding over each other.

FIG. 2 depicts a particularly advantageous embodiment of the invention in which the groove 5 and the tongue 6 are advantageously symmetrically formed in relation to a mid-plane M' running through the components 1, 2, perpendicular to the plane of the drawing.

The projection 7 or the recess 8 according to FIG. 2 is triangular in cross section, the triangle sides 17, 17' closer to the opening of the groove being shorter and inclined at a greater angle than triangle sides 18, 18' located closer to the bottom 11 of the groove. When the tongue 6 is introduced into the groove 5, the longer side 18 of the projection 7 slides on the inner edge or on a chamfered section 25' formed in this area of the leg 3 of the groove until the projection 7 has passed by this inner edge surface 25' and is received by the recess 8.

In the advantageous embodiment depicted in FIG. 2, provision is made for in particular symmetrically arranged projections 7 or recesses 8 to be formed on both opposing tongue surfaces 10, and for recesses and projections matched to these projections 7 or recesses 8 to be provided on both contacting groove surfaces 9, or for the groove 5 and the tongue 6 to be of dovetail configuration and to be matched to one another. This embodiment permits double locking of the two components 1, 2, such a locking arrangement being also easily detachable by moving or pulling the two components 1, 2 apart from each other in the widened plane which they create.

In this embodiment, the longer triangle side 18, or the surface of the projection 7 formed by this side, merges into the front area of the tongue surface 10, after changing direction at 19; the area of the groove surface 9 close to the base of the groove and this front area of the tongue surface 10, like the projection 7 and the recess 8, are in full contact with each other; in this way a very exact connection of the components 1, 2 can be achieved and at the same time it is guaranteed that the end faces of the components 1, 2 are brought into contact with or are brought up close against each other under the exertion of pressure, so that no gap is formed between the components 1, 2 at the functional or top surface 13, or so that the components 1, 2 do not move apart while they are in use.

The area of the groove surfaces 9 close to the base of the groove and the area of the tongue surfaces 10 close to the free end of the tongue 6 possess the same angle of inclination $\gamma$. The angle $\alpha$ enclosed by the surfaces 18 of the projection, or the surface 18' of the recess, and the top surface 13 of the components 1, 2, is greater than the angle $\gamma$. The area of the inner edge surface 25', located close to the opening of the groove, is also inclined at this angle $\alpha$ to the top surface 13 of the two components 1, 2.

The angle $\beta$ at which the shorter triangle sides 17, 17' are inclined is greater than the angle $\alpha$ and advantageously is between 25° and 65° in relation to the top surface 13 of the components 1, 2.

For attaching and detaching the components, it is advantageous if the triangle sides 18, 18' close to the base of the groove are about four to eight times, preferably five to seven times, as long as the triangle sides 17, 17' located away from the base of the groove, and if the angle enclosed by the two triangle sides 17, 18 or 17', 18' is between 100 and 140° and in particular between 110 and 130°.

In order to simplify insertion, it is advantageous if the inside end edges of the tongue 6 are provided with chamfered sections 12 and/or if the inside end edge of the leg 4 of the groove, which leg has no engagement or locking elements, is provided with a chamfered section 29.

By means of the joining method according to the invention, it is possible, and it is intended, that the bottom surfaces 15 of the components 1, 2 to be joined with one another lie in one plane.

In principle, several projections and/or recesses may be formed on the surface of a tongue or groove.

FIG. 3 depicts an embodiment of the invention in which each of the components 1, 2 is provided at its two opposite end faces or on all four end faces with grooves 5 or with tongues 6. The components 1, 2 are thus symmetrically configured relative to their diagrammatically indicated mid-plane M.

The groove 5 or tongues 6 are formed in the same way as was described in connection with FIGS. 1 and 2 or in the preceding description. As can be seen from FIG. 3, the projections 7 and recesses 8 that are in engagement with each other are matched to each other and their cross sectional shape corresponds to that of the projections 7 and recesses 8 described in FIGS. 1 and 2, it is, however, in principle possible to choose other similar cross sectional shapes for the locking elements 7, 8, or to choose for the groove and tongue surfaces angles of inclination relative to the surface 13 of the components 1, 2 that are different from those shown. The elasticity of the legs 3, 4 is important in order to guarantee the engagement of the locking elements 7, 8.

The relatively narrow or strip-shaped component 2 depicted in FIG. 3 possesses two tongues 6 each having a dovetail profile; the relatively broad components 1 depicted in FIG. 3 possess dovetail-shaped grooves 5 at their opposite end faces, in particular at all four end faces.

The components 1 may also be square in shape, and in combination with the strip-shaped components 2 they produce an optically pleasing pattern.

The strip-shaped components 2 are easy to handle or to cut to length; the components 1 may possess grooves 5 around their periphery at the end faces so that all-round connection of the components 1 with the strip-shaped components 2 is possible.

In principle, it is also possible for in each case grooves 5 or tongues 6 to be formed at the opposite end faces or on all end faces of the components 1, 2 to produce components which are symmetrical with reference to their longitudinal plane and possibly also their transverse mid-plane.

What is claimed is:

1. An arrangement of panel shaped or strip shaped building members made of wood, wood material or wood based material comprising:

first and second components each having a top surface, a bottom surface and at least one edge, with a groove defining an opening through the at least one edge of the first component and a tongue projecting from the at least one edge of the second component for receipt through the opening when the edges of the components are in abutment;

the groove having first and second walls converging with respect to the opening from the edge of the first component inward toward a groove bottom, with at least the second wall having an outer portion of a selected extent and an inner portion;

a contact surface disposed proximate the opening and extending obliquely from the second wall with respect to the top or bottom surface of the first component in a divergent direction with respect to the opening of the groove, the contact surface having an extent less than and an angle steeper than the outer portion of the second wall, and the tongue having a first surface for abutting the first wall of the groove when inserted into the groove and a second surface having at least an inner portion abutting and complementing the outer portion of the second wall and a shoulder abutting and complementing the contact surface to positively retain the tongue in the groove.

2. An arrangement according to claim 1, wherein the outer portion of the second wall converges at a steeper angle than the inner portion of the second wall.

3. An arrangement according to claim 1, wherein the edges of the first and second components have end surfaces which diverge from one another when the edges are in abutment and the tongue is seated within the groove.

4. An arrangement according to claim 1, wherein both the first and second walls have an outer portion converging at a steeper angle than the inner portion.

5. An arrangement according to claim 1, wherein the first wall has an additional contact surface disposed proximate the opening of the groove opposite the contact surface extending from the second wall.

6. An arrangement according to claim 1, wherein the first surface of the tongue comprises an inner portion and a shoulder.

7. An arrangement according to claim 1, wherein the first wall of the groove has a converging portion disposed opposite the contact surface.

8. An arrangement according to claim 1, wherein the groove extends along the length of the at least one side of the first component.

9. An arrangement according to claim 1, wherein the tongue extends along the length of the at least one side of the second component.

10. An arrangement according to claim 1, wherein said first and second components comprise at least one plastic laminated layer on the top or bottom surface and optionally comprise a flat bottom surface.

11. An arrangement according to claim 1, wherein at least one of the walls of the groove is flexible, whereby the tongue is insertable into and removable from the groove.

12. An arrangement according to claim 1, wherein the extent of the outer portion of at least the second wall is 4 to 8 times longer than the extent of the contact surface.

13. An arrangement according to claim 1, wherein the extent of the outer portion of at least the second wall is 5 to 7 times longer than the extent of the contact surface.

14. An arrangement according to claim 1, wherein the angle between the outer portion and the contact surface of at least the second wall and the angle between the inner portion and the shoulder of the second surface of the tongue is 100–140°.

15. An arrangement according to claim 1, wherein the angle between the outer portion and the contact surface of at least the second wall and the angle between the inner portion and the shoulder of the second surface of the tongue is 110–130°.

16. An arrangement according to claim 1, wherein the groove is centered on the at least one side of the first component and the tongue is centered on the at least one side of the second component.

17. An arrangement according to claim 1, wherein the first component comprising on at least one side a groove comprises on a side opposite from said at least one side either a tongue or a groove and wherein the second component comprising on at least one side of a tongue comprises on a side opposite from said at least one side either a tongue or a groove.

18. An arrangement according to claim 1, wherein the shortest distance between the top and bottom sides of the first component is the same as the shortest distance between the top and bottom sides of the second component.

19. An arrangement according to claim 1, wherein the shortest distance between the top and bottom sides of the first component is different than the shortest distance between the top and bottom sides of the second component.

20. An arrangement according to claim 1, wherein the first component comprising on at least one side a groove comprises on a side opposite from said at least one side a groove and said first component is panel-shaped and the second component comprising on at least one side a tongue comprises on a side opposite from said at least one side a tongue and said second component is strip-shaped.

21. An arrangement according to claim 1, wherein the first and second walls of the groove have different lengths.

22. An arrangement according to claim 1, wherein the building members are flooring members.

23. A component useful in an arrangement of claim 1, wherein said component is the first component.

24. A component useful in an arrangement of claim 1, wherein said component is the second component.

* * * * *